United States Patent [19]

Williams

[11] Patent Number: 4,497,442

[45] Date of Patent: Feb. 5, 1985

[54] FOAM-APPLYING NOZZLE HAVING ADJUSTABLE FLOW RATES

[75] Inventor: Leslie P. Williams, Port Neches, Tex.

[73] Assignee: Cause Consequence Analysis, Inc., Vidor, Tex.

[21] Appl. No.: 482,499

[22] Filed: Apr. 6, 1983

[51] Int. Cl.[3] ..... A62C 31/12

[52] U.S. Cl. ..... 239/437; 239/318; 239/424.5

[58] Field of Search ..... 239/437–442, 239/314, 317, 318, 419, 424.5, 456, 457; 169/15

[56] References Cited

U.S. PATENT DOCUMENTS

| | | | |
|---|---|---|---|
| 2,198,998 | 4/1940 | Honsberger | 239/318 X |
| 2,538,948 | 1/1951 | Richards | 239/317 |
| 3,548,949 | 12/1970 | Williams et al. | 169/1 |
| 3,562,156 | 2/1971 | Francen | 252/8.05 |
| 3,578,590 | 5/1971 | Niekeker et al. | 252/8.05 |
| 3,772,195 | 11/1973 | Francen | 252/8.05 |
| 4,219,158 | 8/1980 | Lacy | 239/317 X |
| 4,349,157 | 9/1982 | Beiswenger et al. | 239/318 X |

OTHER PUBLICATIONS

Elkhart Brass Manufacturing Co., Inc., Catalog No. S on Fire Fighting Equipment, pp. 2–18, 22–29.

*Primary Examiner*—Jeffrey V. Nase
*Assistant Examiner*—Daniel R. Edelbrock
*Attorney, Agent, or Firm*—Pravel, Gambrell, Hewitt & Kimball

[57] ABSTRACT

A foam-applying nozzle assembly (N) having adjustable flow rates for applying a foam made up from a supply of a foam-forming liquid composition (F) and a flowing liquid stream (W) includes an inner barrel (I) having an axial bore (10) for communicating the liquid stream (W) from a hose. Eductor means (E) with the inner barrel (I) extracts the foam-forming liquid composition (F) from the supply of the foam-forming composition. The eductor means (E) inducts the extracted foam-forming liquid composition (F) into a first portion (W1) of the liquid stream (W) flowing through the eductor means (E). The eductor (E) has a discharge opening (22*o*) in proximity to the outlet (10*m*) of the inner barrel (I) for mixing the foam-forming composition (F) with the liquid stream (W) from the inner barrel (I) in proximity to the discharge of the liquid stream, whereby a foam is created. A deflection plate (32) is mounted inwardly and spaced apart of a mixing plate (12) which is mounted substantially perpendicular to the longitudinal axis (A) of the axial bore of the inner barrel (I). The deflection plate (32) is formed having slanting ducts (32*a*) to communicate a second stream portion (W2) to a mixing chamber 13. Ducts (32*a*) slant at an angle whereby second stream portion (W2) reflects from the mixing plate (12) to a slanted reflection edge (58) of the inner barrel (I).

7 Claims, 5 Drawing Figures

FOAM-APPLYING NOZZLE HAVING ADJUSTABLE FLOW RATES

BACKGROUND OF THE INVENTION

1. Field of the Invention

This invention relates to the field of foam-forming equipment, and more particularly to nozzles for the application of a foam from a foam concentrate mixed with a liquid.

2. Description of the Prior Art

Fire-fighting nozzles for the application of a water stream or a water fog on a fire have been known for some time. Such nozzles are attached to a fire hose carrying a liquid stream, such as water, and frequently are adjustable to apply the fire-extinguishing liquid in a pattern ranging from a fog-like application to a straight stream, an example of which is made by Elkhart Brass Manufacturing Co., Inc. of Elkhart, Ind. However, an application of water is not desirable for all types of fires.

Fire-extinguishing foam-forming liquid compositions have been utilized in the extinguishing of certain types or classes of fires. Many of these foam-forming compositions will, when mixed with water and aerated with large quantities of air, form relatively stable foams, particularly for the extinguishing of large fires. Such liquid foam concentrates are known under the trademarks, "AFFF" of Minnesota Mining and Manufacturing Company, Minnesota and "Emulsiflame" of Elkhart Brass Manufacturing Co., Inc. Other such foams are generally described in U.S. Pat. Nos. 3,772,195; 3,562,156; 3,578,590; and 3,548,949.

The foam-forming liquid compound has been generally supplied as a concentrate which was inducted into the flowing liquid stream by an in-line or by-pass foam eductor. The separate eductor was connected between the nozzle and the liquid stream pump or source. The foam concentrate was withdrawn by the eductor or pumped from the concentrate storage and was then diluted and/or mixed with the liquid stream in the desired concentration. Thereafter, the foam-forming concentrate and liquid mix was aerated in a separate system, forming the foam which discharged from a nozzle.

Generally, the foam applying nozzle used with the separate eductor has been of the same type utilized to apply water. Some water nozzles have had the stem-portion modified (the stem limits and assists in directing the water flow) for the application of the foam. These are non-aspirating peripheral jet nozzles. Additionally, aeration foam tubes are fitted on existing handline nozzles for additional air, which forms a thicker foam blanket.

Using such prior art concept and equipment, wherein the foam was first separately generated and then the foam was discharged through a nozzle, the distance the foam could be projected from the nozzle has been considerably shorter than the distance water alone could be projected through the nozzle. For example, with foam, the maximum distance was usually only about 170 feet whereas with water it was about 300 feet. The separate foam eductor limits the flow (gallonage per minute) and the line pressure to the nozzle. Typically, foam eductors handled between 30 and 250 gallons per minute; whereas, nozzles handled in excess of 1000 gallons per minute. The separate eductor constricted the complete flow of water creating a pressure drop of 30–40% across the eductor. This loss of pressure was created by the flow into the eductor working against backpressure due to the constriction. Thus, the previous separate foam eductor and nozzle limited the flow and range capabilities of the nozzle and required the firefighter to approach the fire more closely.

The discharge distance of foam has previously been increased using a balanced pressure proportioning system. This system included a pump, control valve and orifice which introduced the foam concentrate under pressure into the hose behind the nozzle. Since this system was pressurized, the drop in pressure created by the separate eductor was eliminated, which allowed the full flow pressure to form at the nozzle. The balanced pressure proportioning system was rather cumbersome, required a power source for the pump, and was more expensive than the separate eductor and nozzle system. The present invention discharges the foam generally the same distance as the balanced pressure proportioning system, while eliminating the additional equipment, such as the pump, control valve and orifice.

SUMMARY OF THE INVENTION

The present invention relates to a new and improved nozzle for applying a foam made up from a foam-forming liquid composition and a flowing liquid stream such as water. An inner barrel having an inlet and outlet communicates the liquid stream from a hose. Eductor means with the inner barrel extracts the foam-forming liquid composition from a supply of the concentrate and inducts the foam-forming liquid composition into a portion of the liquid stream flowing through the nozzle. The foam concentrate-liquid mixture is aerated and formed in the desired pattern. An adjustable flow regulating nozzle means is mounted in the outlet of the inner barrel and regulates the lateral extent and rate of flow (gallons per minute) of the stream discharged.

The present nozzle for applying foam has improved focus for the foam discharged from the nozzle in stream-like applications. The foam stream has a reduced dispersion than that discharged by previous nozzles. As a result of the focusing of the stream, the present invention applies, or throws, the foam over a greater distance thereby allowing the firefighter operating the nozzle to be further removed from the fire.

Additionally the flow regulating means for the liquid stream is adjustable unlike previous nozzles which have a fixed configuration to discharge a preset flow of liquid. Similarly, the rate of foam concentrate inducted is adjustable with the present invention. The present nozzle with the combination of sets of adjustments for the liquid stream flow rate and the foam concentrate foam rate eliminates the need for a large number of the fixed configuration nozzles required to handle the varying firefighting conditions.

DESCRIPTION OF THE PREFERRED EMBODIMENT

Figure 1:
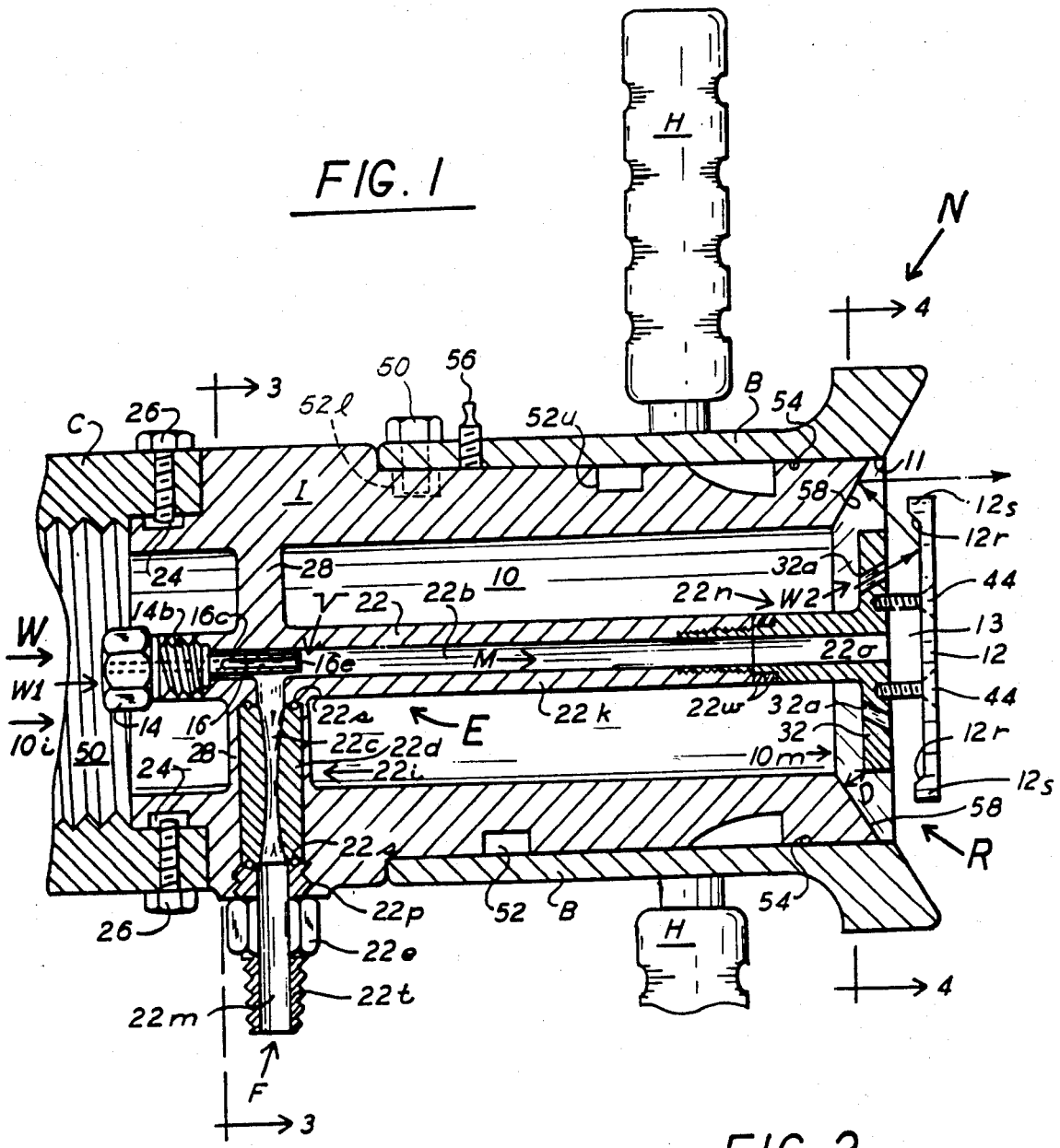
FIG. 1 is a cross-sectional view of the present invention.

In the drawings, the letter N refers generally to the nozzle of this invention which is adapted for applying a foam, such as the type for fire-extinguishing, made up from a foam-forming liquid composition F and a flowing liquid stream W. Briefly, the nozzle N includes an inner barrel I having an axial bore 10 with inlet 10*i* and outlet 10*m* for directing the liquid stream W from a hose, monitor or other source (not shown) and having further a flow regulating nozzle means R coacting with the outlet 10*m* for regulating the lateral extent and the flow of the stream W discharged from the inner barrel I, so that the discharged fluid stream may be varied from a relatively compact small diameter stream to a wider, larger diameter fog-like spray. Eductor means E with the inner barrel I extracts the foam-forming fire-fighting liquid composition F from a supply of the foam-forming composition F. The eductor means E inducts a selected amount of the foam-forming liquid composition F into a first portion W1 of the liquid stream W flowing through the inner barrel I. The remaining liquid stream W flows parallel to the longitudinal axis of the inner barrel I. A mixing plate 12 and a spaced-apart deflection plate 32 form a mixing passage or chamber 13 therebetween for receiving the foam-forming composition diluted in the first liquid stream portion W1. The mixing plate 12 is preferably mounted with the eductor E substantially perpendicular to the longitudinal axis A of the inner barrel I to assist in aerating and directing the foam-forming liquid which has been inducted into the first liquid stream portion W1 as the foam concentrate/liquid mixture impacts the mixing plate 12, forming the foam. Deflection plate 32 directs the main portion of liquid stream W radially from the outlet 10M of inner barrel I. An outer sleeve B is generally movably mounted with the inner barrel I for directing or focusing the liquid stream in the desired form of application. Coupling C of conventional construction has internal threads 50 for threaded engagement with a typical hose coupling on a fire hose (not shown), so as to direct the liquid stream W from the hose through the nozzle N.

An inducting-type of foam nozzle has been generally described in copending application Ser. No. 399,112.

Referring now more particularly to FIG. 1, the eductor means E is generally an eductor or a venturi-type tube V mounted within the axial bore 10 of inner barrel I and axially aligned with the flow of the liquid stream being generally in the direction of the arrow shown in FIG. 1. As the liquid stream W flows into the inlet 10*i* of the bore 10 of the inner barrel I from the hoses or source, a first portion W1 of the stream W flows into a tubular constricting member 14 having an axial bore 16. The axial bore 16 has a constricting portion 16*c* having a substantially uniform diameter ending with an opening 16*e* of smaller diameter than the axial bore 22*b* of T-shaped tubular member 22. Preferably, member 14 is a threaded bolt 14*b* having an axial bore in communication with the axial bore 16 of a short tubular segment 16*c* mounted to the threaded end of the bolt.

The first stream portion W1 exits from the member 14 at exit or opening 16*e* and enters the axial bore 22*b* of T-shaped tubular member 22. One branch of T-shaped tubular member 22 is adapted to receive tubular constricting member 14 while the lower base segment 22*i* is adapted to receive the foam concentrate F. The interior cavity or bore 22*b* is larger dimensionally than the opening 16*e* and constricting section 16*c* of member 14 thus causing the flow of stream portion W1 to expand in bore 22*b*. The expansion decreased the flow rate of the liquid stream portion W1 flowing through the venturi V. This slowing of the flow rate in bore 22*b* after exiting from opening 16*e* creates a reduced pressure in the bore 22*b* due to a venturi effect.

As stated, the tubular member 22 forms a T-shaped body with lower inlet portion 22*i* extending through the inner barrel I. The exposed end of inlet portion 22*i* has threads 22*t* for receiving a hose or tubular means T (not shown) for communicating the foam-forming liquid concentrate F from a separate supply of the foam concentrate, such as a drum or canister (not shown). The reduced pressure created by the venturi effect in the member 22, transmitted through tubular means T, causes the foam concentrate F to flow from its supply so as to induct the concentrate F into the stream portion W1 in bore 22*b*.

Inlet portion 22*i* includes therein a removable cylindrical orifice body 22*d* with an orifice 22*c* secured by threadedly removable coupling or nipple 22*e*. The diameter of orifice 22*c* controls the flow of foam concentrate F inducted into bore 22*b*. Orifice body 22*d* with O-ring seals 22*s* mounted on its upper and lower sides is removable and replaceable thus permitting the selection of the desired foam concentrate flow by choosing an orifice body 22*d* with the corresponding orifice 22*c* diameter necessary. Coupling 22*e* with threads 22*t* for receiving tubular means T and threads 22*p* for threadedly mounting body 22*e* with inner barrel I secures orifice body 22*d*. Coupling 22*e* has an inner bore 22*m* to communicate the foam concentrate F to orifice 22*c* for induction into bore 22*b*.

Tubular member 22 is mounted having the axial bore 22*b* substantially axially aligned with the flow of the liquid stream W. Member 22 has discharge end 22*n* with an outlet 22*o*, preferably removable, disposed in proximity to the mixing plate 12 and the outlet 10*m* of the inner barrel I, whereby the foam-forming liquid composition which was inducted into the stream portion W1 forming a mixture M impacts upon the mixing plate 12. The outlet 22*o* of exit member 22 is spaced apart from mixing plate 12 by means of spacers 44 to allow the impacted mixture to flow outwardly from the exit member 22 and mix the foam-forming composition with a second portion W2 of liquid stream W, which second portion W2 flows through a plurality of slanted ducts 32*a* in deflection plate 32.

Figure 3:
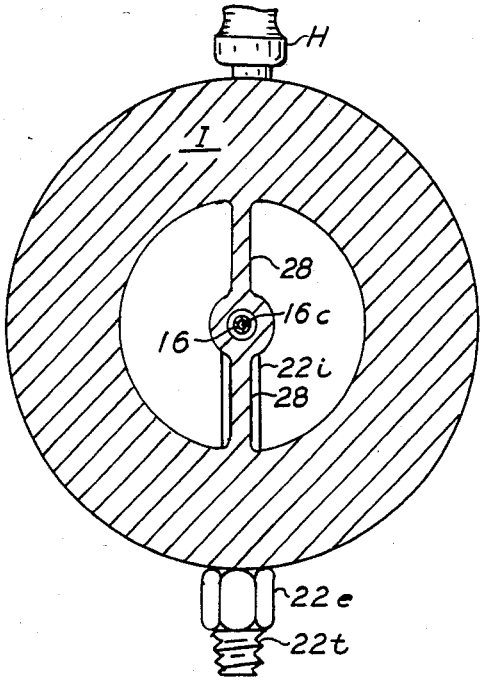
FIG. 3 is a cross-sectional view of the present invention along line 3—3 of FIG. 1.

Stuts or supports 28 (FIGS. 1 and 3) position and support eductor 22 within bore 10 of inner barrel I. Openings are formed between adjacent supports 28 through which the liquid stream W flows.

Inner barrel I is generally a metallic tubular segment. (FIG. 2) An annular groove 24 at the exterior base of inner barrel I coacts with set screw or bolt 26 mounted in coupling C to rotatably mount and secure coupling C to the base of inner barrel I when set screw 26 extends into groove 24.

Figure 2:
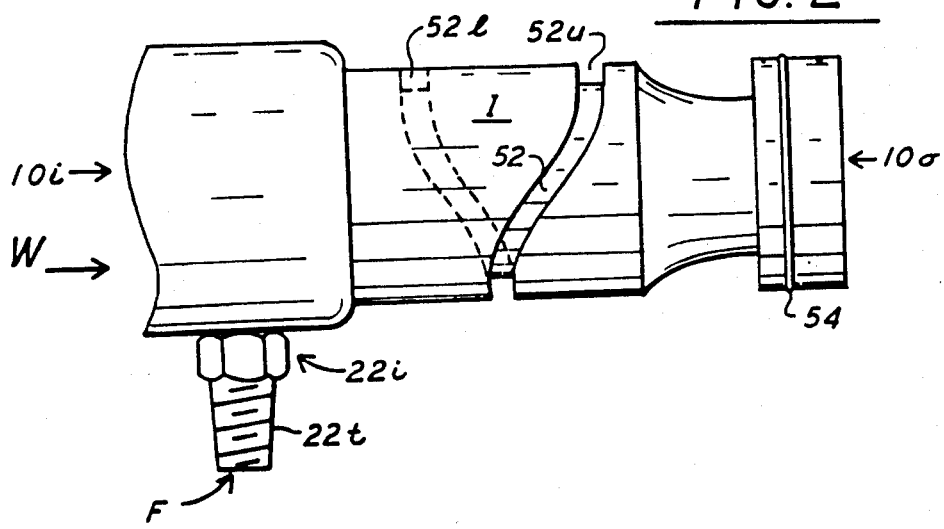
FIG. 2 is a side view of the inner barrel of the present invention.

The flow regulating nozzle means R generally includes the deflection plate 32 coacting with the outer sleeve or barrel B, being a metallic tubular member having an axial bore 11 and telescopically mounted with inner barrel I and with an annular slanted reflection edge 58 of the exit end 10*m* of inner barrel I. Deflection plate 32 is spaced apart by distance D from the annular edge 58 to provide the opening through which a portion of the fluid stream W flows. As outer sleeve B is rotated or moved relative to the inner barrel I, bolt or pin 50 extending through the outer barrel B is guided through a helical groove 52 thereby moving the outer barrel B longitudinally relative to inner barrel I, which increases the overall length of nozzle N. Referring to FIG. 2 groove 52 preferably extends in a helical manner about inner barrel I. FIG. 2 depicts groove 52 extending around the side of inner barrel I hidden from view with phantom lines. Groove 52 has an inner position 52*l* and an outer position 52*u*. When bolt 50 is moved to inner position 52*l*, then outer barrel B is fully retracted onto inner barrel I. Similarly when outer barrel B is moved such that bolt 50 is at the outer position 52*u*, outer barrel B is fully extended relative to inner barrel I. The rotation of outer sleeve B controllably selects the type of application, which ranges between positions creating a fog-like foam application and a position forming a straight-stream foam application.

At least one handle H preferably extends from outer sleeve B to assist in rotating the outer sleeve B. Grease coupling or nipple 56 mounted with outer barrel B communicates grease or other lubricant to the space between inner barrel I and outer barrel B for reducing friction between the two surfaces as they are rotated relative to each other. O-ring 54 mounted with inner barrel I forms a seal between inner barrel I and outer barrel B.

Figure 4:
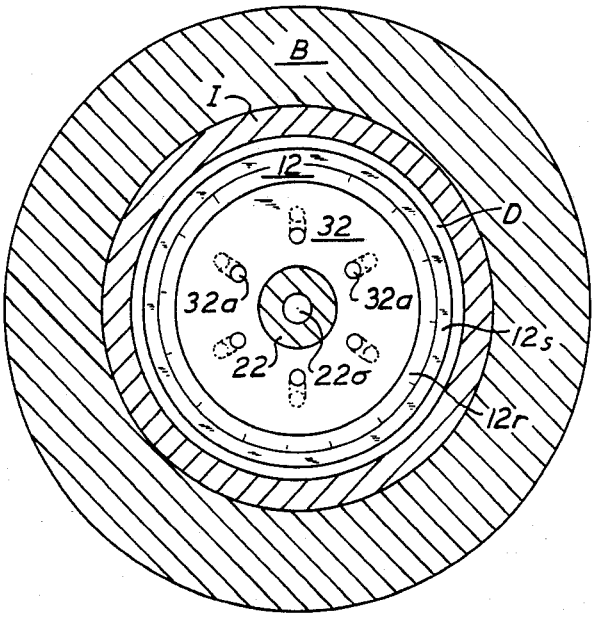
FIG. 4 is a cross-sectional view of the present invention taken along line 4—4 of FIG. 1; and, FIG. 5 is an enlargement of a segment of the discharge end of the invention of FIG. 1.

As mentioned above ducts 32*a* in deflection plate 32 are formed at a slanted angle from the longitudinal axis A of the inner barrel I. Preferably, the ducts 32*a* are symmetrically spaced about the center of deflection plate 32. See FIG. 4. The second stream portion W2 is communicated through ducts 32*a* which are formed at the angle whereby second stream portion W2 having passed through a duct 32*a* is reflected from mixing plate 12 to the slanted reflection edge 58 of the inner barrel I. The second stream portion W2 is then reflected from the slanted reflection edge 58 substantially parallel to the inner bore longitudinal axis for improved focusing of the foam stream as it is discharged from nozzle N. The remainder of stream W impacts upon the interior side of mixing plate 32 and is directed radially toward reflective edge 58 and is then combined with the foam concentrate and liquid mixture. The slanting of ducts 32*a* as described also improves the mixing in mixing chamber 13 of the second stream portion W2 and the foam concentrate/liquid mixture discharged from the opening 22*o*.

Figure 5:
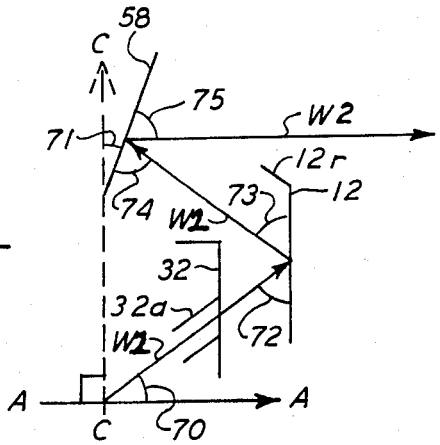

Referring now to FIG. 5 the longitudinal axis A of the inner barrel I is generally depicted by the arrow A—A. Line or axis C—C is perpendicular to axis A—A. First angle 70 is the angle at which ducts 32*a* are slanted outwardly from the longitudinal axis A of the inner barrel I. Second stream portion W2 flows through ducts 32*a* and impacts upon the surface of mixing plate 12 at an incidence angle 72. Second stream W2 reflects from the surface of deflection plate 12 at a reflection angle 73. Angles 72 and 73 are of equal angular measure. The second stream portion W2 having reflected from deflection plate 12 then impacts upon slanted reflection edge 58 at the incidence angle 74. The second stream portion W2 then reflects from reflection edge 58 at a reflection angle 75. The second stream portion W2 having been reflected from edge 58 is directed substantially parallel to longitudinal axis A. Then incidence angle 74 is equal in angular measure to the reflection angle 75. The slanted reflection edge 58 is slanted at a second angle 71 from the line C—C which is perpendicular to the longitudinal axis A of the inner barrel I. The second angle 71 is equal to one-half of the first angle 70 in order for the first stream portion W1 being discharged from the nozzle N to have a reduced dispersion angle and a thinner stream application.

Preferably the discharge end 22*n* with reflection plate 32 attached is threadedly connected to the main portion 22*k* of tubular member 22 and is also removable. As the distance D between the edge of plate 32 and slanted edge 58 controls or regulates the amount of flow of the liquid stream W through nozzle N, washers or spacers 22*w* are added or removed between the removable portion 22*n* and the main portion 22*k* to select the desired distance D.

As is shown in FIG. 1 mixing plate 12 is formed with an annular shoulder 12*s* having a reflective surface 12*r* for directing the foam concentrate and liquid mixture toward the slanted reflection edge 58 of the inner barrel I as the mixture is radially ejected from mixing chamber 13. Reflective surface 12*r* increases the focus of the foam/liquid mixture as it is discharged from the nozzle N which reduces the dispersion of the straight stream type of discharge from nozzle N, thereby producing a thinner stream.

OPERATION

In the operation of the foam applying nozzle N, nozzle N is affixed to a hose with coupling C. Generally the liquid stream is water pumped from a fire hydrant or fire truck or other suitable pump. A tube T (not shown) is connected to inlet 22*i* and placed within the supply of foam concentrate F.

As the water W is pumped into nozzle N in the direction of the arrow in FIG. 1, a first portion W1 of the water stream W flows into the bore 16 of member 14. As water W1 flows through constricting portion 16*c*, the velocity increases. As the water W1 enters bore 22*b* the venturi effect from the expanding flow creates a reduced pressure in bore 22*b* which is communicated through foam inlet 22*i* and the tube T to cause the foam concentrate F to flow from its supply, which is generally at atmospheric pressure. The foam concentrate F is inducted into the water stream W1 in bore 22*b* and is diluted forming a foam concentrate/water mixture M. The foam concentrate/water mixture is discharged from the outlet end 22*o* into mixing passage 13 and impacts mixing plate 12. Upon impact the mixture is partially aerated initially forming the foam. Due to the constant flow of the concentrate/water mixture from outlet 22*o*, the mixing plate 12 and spaced apart deflection plate 32 direct the mixture outwardly from exit member 22. At the same time a second portion W2 of the water flow W is directed through slanted ducts 32*a* to mix further with the foam/liquid mixture already in mixing chamber 13. This mixture exits outwardly from chamber 13 and is directed by shoulder 12*s* and by the reflection of second stream portion W2 from plate 12 toward annular reflection surface 58. The remainder of stream W is communicated through the bore of nozzle N at a high pressure and impacts upon the interior surface of deflection plate 32. This remaining portion of the water stream W is then directed outwardly between the outer edge of the plate 32 and the reflection surface 58 to combine with the first and second portions W1, W2 and discharges from the chamber 13 so that entire discharge is finally controlled by the annular surface 58, subject to variations by the position of the outer sleeve B.

The extension or retraction of outer sleeve B may be used to change the pattern of the foam exiting the nozzle N from a substantially straight-stream which is essentially parallel to the longitudinal axis of the nozzle, to a wider spray when in the fully retracted position. When the outer sleeve B is fully extended relative to inner barrel I, the radial flow of the water stream W being deflected by deflection plate 32 and the concentrate/water mixture from mixing chamber 13 contacts the interior surface of axial bore 11 and slanted edge 58 of the outlet 10*m* of axial bore 10 to focus and direct the flow into a straight stream with reduced dispersion exiting from the nozzle N between bore 11 and the edges of plates 12 and 32.

When outer sleeve B is fully retracted onto inner barrel I, the radial flow of both the water W deflected by deflection plate 32 in the outlet 10*m* and the foam concentrate/water from mixing passage 32 mixture is obstructed by only a minimum of the interior surface of bore 11 of outer barrel B so that the flow pattern is fog-like.

The gallonage of water flow and proportion of foam concentrate to water are variable by adjusting the distance D between plate 32 and slanted edge 58 through the addition or removal of spacers 22*w*. As deflection plate 32 is moved relative to slanted edge 58, the passage for the flow of stream W between edge 58 and the edge of disk 32 varies regulating the flow of stream W. Moving plate 32 toward the interior of inner barrel I restricts the flow of liquid stream W and raises the proportion of foam concentrate relative to stream W. Similarly, moving plate 32 from the interior of inner barrel I increases the flow of stream W and decreases the relative concentration of foam concentrate.

With the present invention, there is improved mixing of the foam concentrate and the liquid. This results in a better formed foam. Also the stream-like application of the foam has a reduced dispersion angle, making a thinner stream as it is discharged from the nozzle due to the improved focusing of the initial foam/liquid mixture as it is discharged from the mixing chamber 13. With a reduced dispersion angle the throw (or distance travelled) for the stream application is greater than with previous foam nozzles. Furthermore, the present invention eliminates the prior factory presetting of the rate of flow of the nozzle. Presetting of the nozzle required having several nozzles with each corresponding to a fixed flow rate. With the present nozzle the selection of the number of removable washers 22*w* controls the distance D and thereby the flow rate of main portion fluid stream W through the nozzle for the desired application. Similarly the removable orifice 22*d* of the present invention controls the amount of foam concentrate inducted. The combination of any number of pairs of orifices 22*d* and washers 22*w* eliminates the previous requirement to have fixed characteristic nozzles for each desired operating condition.

The single unit construction of the present invention reduces the weight of the apparatus which previously included the nozzle, separate eductor and connecting hose or monitor, thus benefiting fire-fighters. With the increased range of the present invention, the fire-fighter operating the nozzle N does not have to approach the fire as closely as was previously required with the prior apparatus and methods.

The foregoing disclosure and description of the invention are illustrative and explanatory thereof, and various changes in the size, shape and materials, as well as in the details of the illustrated construction may be made without departing from the spirit of the invention.

I claim:

1. A nozzle assembly for applying a foam of the type which includes an inner barrel and a telescoping outer barrel each having an axial bore with an inlet and an outlet, and eductor means within the inner barrel having means for mixing a first portion of a liquid stream flowing through the inner barrel with a foam-forming concentrate and discharging the foam concentrate and liquid mixture through a discharge opening in proximity to the inner barrel outlet, the improvement residing in means for focusing the stream of foam discharged from the nozzle, comprising:

a slanted reflection edge formed on the outlet of the inner barrel;

the eductor means having:

a mixing plate mounted substantially perpendicular to the longitudinal axis of the axial bore of the inner barrel;

a deflection plate mounted inwardly and spaced from said mixing plate to form a mixing chamber therebetween for receiving the foam-forming composition discharged from the eductor means; and, said deflection plate being formed with a plurality of ducts through said deflection plate to direct a second portion of the liquid stream flowing through the inner barrel to said mixing chamber, said ducts being formed in a slanting direction from the longitudinal axis of the inner bore whereby the second liquid stream portion first reflects from said mixing plate to said slanted reflection edge of the inner barrel and then reflects from said slanted edge substantially parallel to the axial bore of the inner barrel.

2. The invention of claim 1, wherein the eductor means includes:

an inlet communicating with a source of foam-forming concentrate; and, a removable orifice body in said inlet for controlling the flow of the foam-forming concentrate.

3. The invention of claim 1, wherein said mixing plate is formed with an annular shoulder having a reflective surface for directing the foam concentrate and liquid mixture toward said slanted reflection edge of the inner barrel.

4. The invention of claim 1, further including removable spacers mounted with said deflection plate for selectively controlling quantity of the flow of the liquid stream through the inner barrel.

5. The invention of claim 1, wherein said slanted reflection edge is annular.

6. The invention of claim 1, wherein said deflection plate is spaced from said slanted reflection edge to provide an opening through which fluid flows.

7. The invention of claim 1, wherein:

said ducts are slanted outwardly at a first angle from the longitudinal axis of the inner barrel; and, said slanted reflection edge is slanted at a second angle from a line perpendicular to the longitudinal axis of the inner barrel substantially equal to one half of said first angle.

* * * * *